US008695160B2

(12) United States Patent
Hwang et al.

(10) Patent No.: US 8,695,160 B2
(45) Date of Patent: Apr. 15, 2014

(54) NOZZLE OF VACUUM CLEANER

(75) Inventors: Geun-Bae Hwang, Changwon-si (KR); Kyeong-Seon Jeong, Changwon-si (KR)

(73) Assignee: LG Electronics Inc., Seoul (KR)

( * ) Notice: Subject to any disclaimer, the term of this patent is extended or adjusted under 35 U.S.C. 154(b) by 27 days.

(21) Appl. No.: 13/505,531

(22) PCT Filed: Nov. 9, 2009

(86) PCT No.: PCT/KR2009/006543

§ 371 (c)(1),
(2), (4) Date: May 2, 2012

(87) PCT Pub. No.: WO2011/055872

PCT Pub. Date: May 12, 2011

(65) Prior Publication Data

US 2012/0227211 A1 Sep. 13, 2012

(51) Int. Cl.
*A47L 9/02* (2006.01)
*A47L 9/04* (2006.01)

(52) U.S. Cl.
USPC ..... 15/382; 15/387

(58) Field of Classification Search
USPC ..... 15/382, 387
See application file for complete search history.

(56) References Cited

U.S. PATENT DOCUMENTS

| | | | | |
|---|---|---|---|---|
| 2,289,324 | A * | 7/1942 | Dettle | 15/364 |
| 2,789,786 | A * | 4/1957 | Mefford et al. | 415/157 |
| 2005/0125942 | A1* | 6/2005 | Song | 15/387 |

FOREIGN PATENT DOCUMENTS

| | | |
|---|---|---|
| JP | 2005-177485 | 7/2005 |
| JP | 2009-066331 | 4/2009 |
| KR | 10-2007-0109390 | 11/2007 |
| KR | 10-0855677 | 9/2008 |

OTHER PUBLICATIONS

International Search Report issued in PCT Application No. PCT/KR2009/006543 dated Aug. 9, 2010.
Australian Office Action dated Oct. 9, 2012 issued in Application No. 2009355006.

* cited by examiner

*Primary Examiner* — Mark Spisich
*Assistant Examiner* — Andrew A Horton
(74) *Attorney, Agent, or Firm* — Ked & Associates, LLP

(57) ABSTRACT

Provided is a nozzle of a vacuum cleaner. The nozzle of the vacuum cleaner includes a main body having a foreign material suction hole, a plurality of rotation members rotatably disposed on the main body, a connection member supported linearly movably by the plurality of rotation members, and a swinging member coupled to the connection member, the swinging member being vertically swung according to the movement of the connection member. The plurality of rotation members includes a plurality of sidewalls spaced from each other and a blade fixed to each of the plurality of sidewalls.

10 Claims, 9 Drawing Sheets

NOZZLE OF VACUUM CLEANER

BACKGROUND

Embodiments relate to a nozzle of a vacuum cleaner, and more particularly, to a nozzle of a vacuum cleaner having a function which brushes off the dusts attached to bedclothes to suck the dusts.

In general, a cleaner is a device that sucks air containing dusts using a vacuum pressure generated by a suction motor mounted in a main body thereof to filter the dusts within the main body.

The vacuum cleaner may be classified into a canister type vacuum cleaner in which a nozzle part for sucking air containing foreign materials of a surface to be cleaned (hereinafter, referred to as a cleaning surface) is separated from a main body and connected to the main body through a connection tube and a upright type vacuum cleaner in which a nozzle part is integrated with a main body.

The canister type vacuum cleaner includes a cleaner main body including a motor for generating a suction force, a suction nozzle for sucking dusts of a cleaning surface using the suction force generated in the cleaner main body, a connection hose connecting the main body to the suction nozzle, and an extension tube.

In brief, according to an operation of the vacuum cleaner including the above-described parts, when a motor for applying a power into the cleaner main body is driven, a suction force is generated. Thus, air containing foreign materials of the cleaning surface may be sucked into the suction nozzle by the suction force.

Also, the air containing the foreign materials may be introduced into the cleaner main body through the connection hose and the extension tube. The air containing the foreign materials sucked into the cleaner main body may be separated from the foreign materials while flowing into the cleaner main body. The separated foreign materials are stored in the cleaner main body, and the air separated from the foreign materials is discharged to the outside of the cleaner main body.

However, in the suction nozzle of the vacuum cleaner according to a related art, the vacuum cleaner may suck foreign materials only on a plane such as a floor. Thus, it may be difficult to clean bedding such as a blanket.

That is, since dusts are attached to a surface of the bedding such as the blanket and the bedding is absorbed toward suction hole of the suction nozzle by the suction force of the suction nozzle, it may be difficult to effectively clean the bedding.

Thus, the cleaning process may be repeated several times at the same position or be performed using the suction nozzle after the bedding may be swung one by one to brush off the dusts. Therefore, this may result in inconvenience.

SUMMARY

Embodiments provide a vacuum cleaner in which dusts attached to bedding are brushed off for oneself to suck the dusts.

Embodiments also provide a suction nozzle of a vacuum cleaner in which it can prevent bedding from being absorbed toward a suction hole during the cleaning.

In one embodiment, a nozzle of a vacuum cleaner includes: a main body having a foreign material suction hole; a plurality of rotation members rotatably disposed on the main body; a connection member supported linearly movably by the plurality of rotation members; and a swinging member coupled to the connection member, the swinging member being vertically swung according to the movement of the connection member, wherein the plurality of rotation members includes: a plurality of sidewalls spaced from each other; and a blade fixed to each of the plurality of sidewalls.

The details of one or more embodiments are set forth in the accompanying drawings and the description below. Other features will be apparent from the description and drawings, and from the claims.

DETAILED DESCRIPTION OF THE EMBODIMENTS

Hereinafter, exemplary embodiments will be described with reference to the accompanying drawings. The invention may, however, be embodied in many different forms and should not be construed as being limited to the embodiments set forth herein; rather, that alternate embodiments included in other retrogressive inventions or falling within the spirit and scope of the present disclosure will fully convey the concept of the invention to those skilled in the art.

Figure 1:
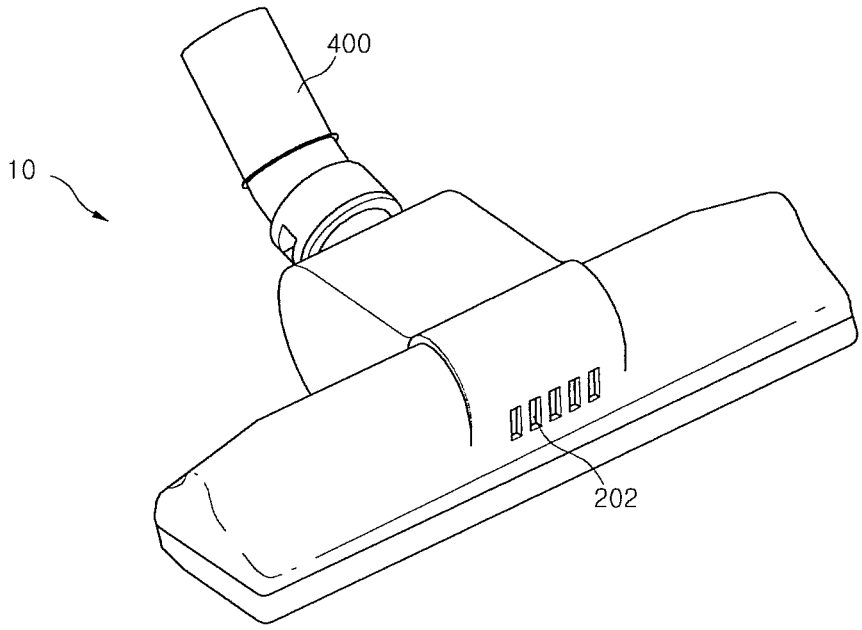
FIG. 1 is a perspective view of a suction nozzle of a vacuum cleaner according to an embodiment.
Figure 2:
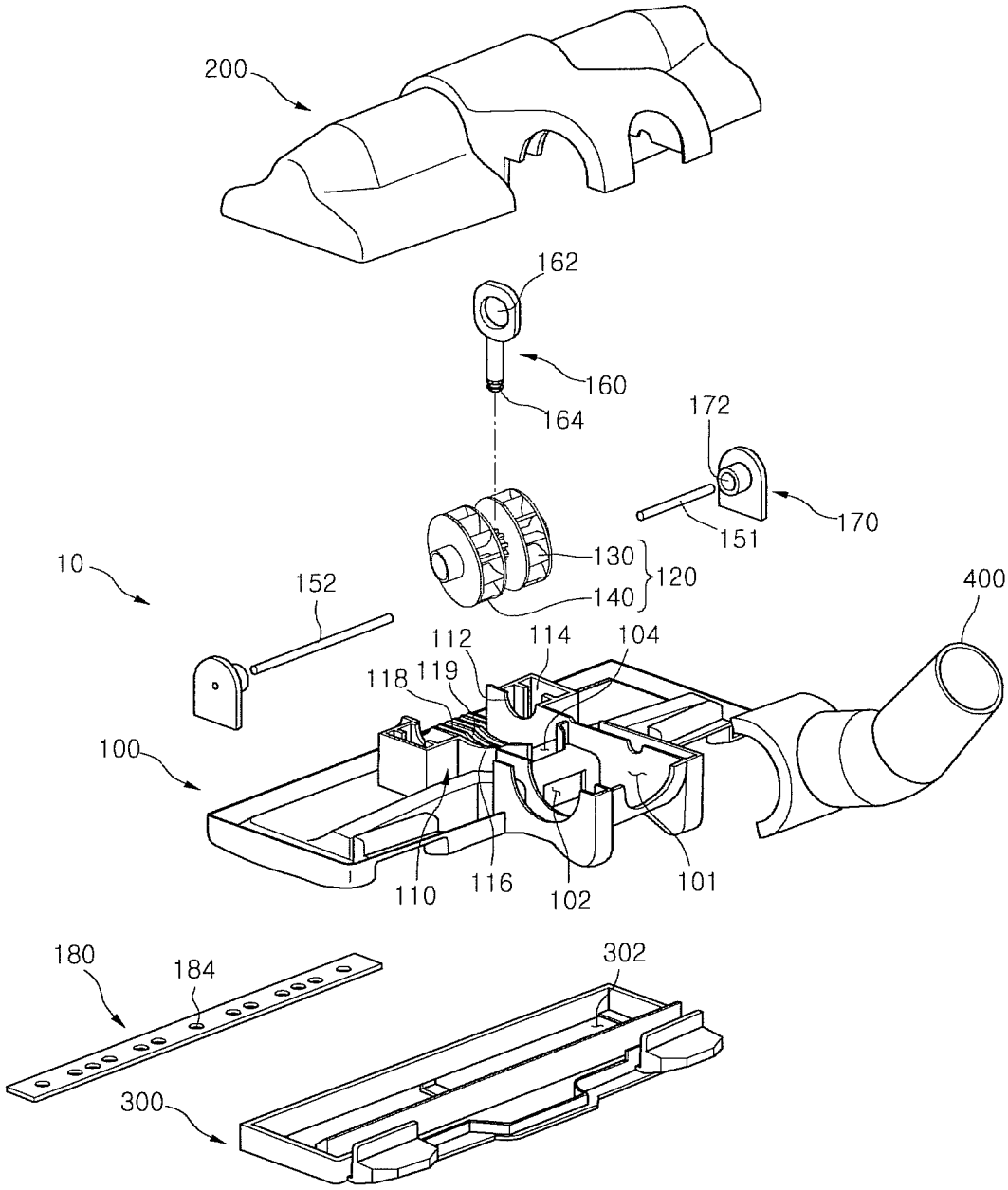
FIG. 2 is an exploded perspective view of the suction nozzle according to an embodiment.

FIG. 1 is a perspective view of a suction nozzle of a vacuum cleaner according to an embodiment. FIG. 2 is an exploded perspective view of the suction nozzle according to an embodiment.

Referring to FIGS. 1 and 2, a suction nozzle 10 according to an embodiment includes a nozzle body 100 defining an outer appearance of the suction nozzle 10 and including a plurality of parts, an upper cover 200 coupled to an upper portion of the nozzle body 100 to define an outer appearance of an upper portion of the suction nozzle 10, and a lower cover 300 coupled to a lower portion of the nozzle body 100 to define an outer appearance of a lower portion of the suction nozzle 10.

A suction pipe 400 connected to a connection hose (not shown) of a cleaner main body (not shown) to introduce sucked air into the cleaner main body is rotatably seated on the nozzle body 100.

In detail, the suction nozzle 10 includes a rotation member 120 rotated by the sucked air, a connection member 160 coupled to the rotation member 120 to change a rotation movement of the rotation member 120 into a vertical linear movement, a swinging member coupled to the connection member 160 and including a plurality of hitting projections (see reference numeral 182 of FIG. 8) brushing off foreign materials attached to a bedding, and a plurality of support members 170 for supporting both sides of the rotation member 120.

A plurality of seat parts 110 on which the rotation member 120 is seated are symmetrically disposed with a predetermined distance on the nozzle body 100. Each of the seat parts 110 includes a seat groove 112 rounded downward to seat the rotation member 120 and a support member receiving part 114 for receiving the support member 170.

Also, a first rotation member 130 and a second rotation member 140 are coupled to each other to form the rotation member 120. A first rotation rod 151 is coupled to a central portion of the first rotation member 130, and a second rotation rod 152 is coupled to a central portion of the second rotation member 140. The first and second rotation members 130 and 140 are rotatably disposed with respect to the centers of the first and second rotation rods 151 and 152, respectively.

Also, in a state where the first and second rotation rods 151 and 152 are respectively coupled to the plurality of support members 170, the first and second rotation members 130 and 140 are seated on the seat part 110.

The support member 170 has a rotation rod coupling hole 172 to which each of the first and second rotation rods 151 and 152 is coupled. Each of the first and second rotation rods 151 and 152 is inserted into the rotation rod coupling hole 172 and thus stably supported. Thus, the rotation member 120 may be firmly coupled to the support member 170 by the first and second rotation rods 151 and 152. Also, the rotation member 120 may be stably rotated in a state where the rotation member 120 is seated on the seat part 110.

Also, a connection member through-hole (see reference numeral 116 of FIG. 8) through which a predetermined portion of the connection member 160 passes is defined between the plurality of seat parts 110. Also, the connection member 160 passes through the connection member through-hole 116 and is coupled to the swinging member 170.

For this, a coupling end 164 coupled to the swinging member 180 is disposed on a lower end of the connection member 160. A coupling hole 184 coupled to the coupling end 164 is defined in an approximately central portion of the swinging member 180.

A plurality of guide ribs 118 for guiding a flow of air sucked through an air suction hole 202 are disposed with a predetermined distance on a front end of an upper portion of the nozzle body 100. The guide ribs 118 may divide a passage 119 of the sucked air into plurality to reduce a sectional area of the passage 119, thereby increasing a rate of the air.

As the rate of the sucked air is increased, a rotation rate of the rotation member 120 is increased. Thus, a swinging rate of the swinging member 180, i.e., a vertical movement rate of the swinging member 180 may be increased. Also, as the vertical movement rate of the swinging member 180 is increased, foreign materials attached to the bedding may be effectively brushed off. In addition, it may prevent the bedding from being absorbed to the suction nozzle 10 when the foreign materials are sucked.

The air suction hole 202 through which air for rotating the rotation member 120 is sucked may pass through a front surface of the upper cover 200. A foreign material suction hole 302 through which air containing the foreign materials brushed off from the cleaning surface is sucked is defined in the lower cover 300.

In detail, the air suction hole 202 may be provided in plurality. The plurality of air suction holes 202 may be vertically defined to effectively rotate the rotation member 120. This is done for a reason in which a flow rate of the air sucked using the same principle as that of the guide rib 118 is increased to increase a rotation rate of the rotation member 120.

The air suction hole 202 may be defined in a position corresponding that of the air passage 119 defined between the guide ribs 118 to smoothly suck air. Here, the air suction hole 202 may be disposed above or under a horizontal center of the rotation member 120 so that the rotation member 120 is rotated in one direction. In the current embodiment, the air suction hole 202 is disposed under a center of the rotation member 120.

On the other hand, the guide rib 118 may be disposed on a bottom surface of the upper cover 200 except for the nozzle body 100. In this case, the air suction hole 202 may be disposed above the horizontal center of the rotation member 120.

On the other hand, a space part 101 in which the air rotating the rotation member 120 and the foreign material sucked from a lower side of the nozzle body 100 are gathered is defined at a rear side of the nozzle body 100. As described above, the air rotating the rotation member 120 is sucked through the air suction hole 202, and the air containing the foreign materials is sucked through the foreign material suction hole 302.

For this, the nozzle body 100 has a communication hole 104 for introducing the air rotating the rotation member 120 into the space part 101 and an inflow hole 102 for introducing the air containing the foreign materials sucked from the bottom surface of the nozzle body 100. Also, the air and foreign materials gathered into the space part 101 are sucked into the suction pipe 400 and then sucked into the cleaner main body.

The connection member 160 includes a coupling hole 162 coupled to the rotation member 120 and a coupling end 164 extending downward from the coupling hole and coupled to the swinging member 180. The coupling hole 162 is defined in position at which the first and second rotation members 130 and 140 are coupled to each other. At least one portion of the rotation member 120 may pass through the coupling hole 162.

Figure 3:
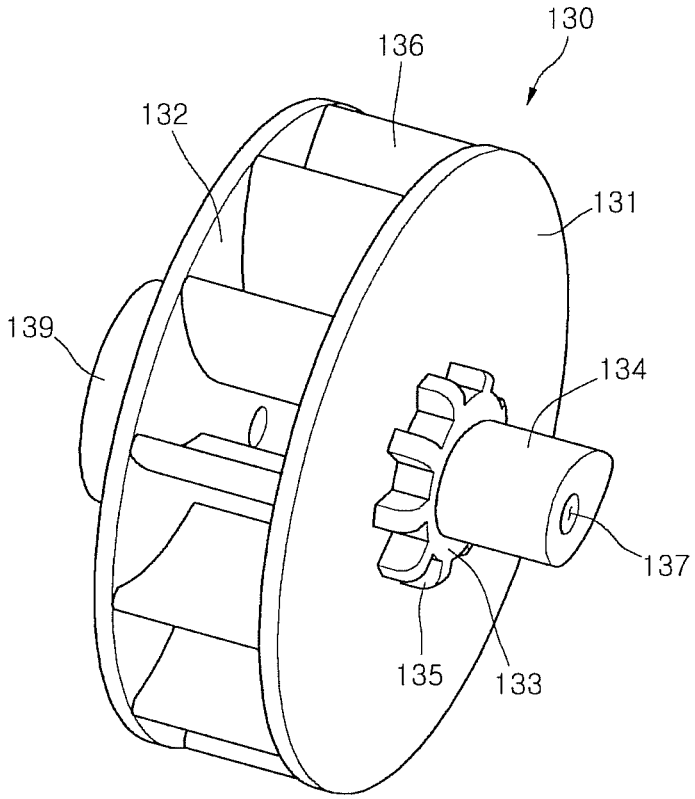
FIG. 3 is a perspective view of a first rotation member according to an embodiment.
Figure 4:
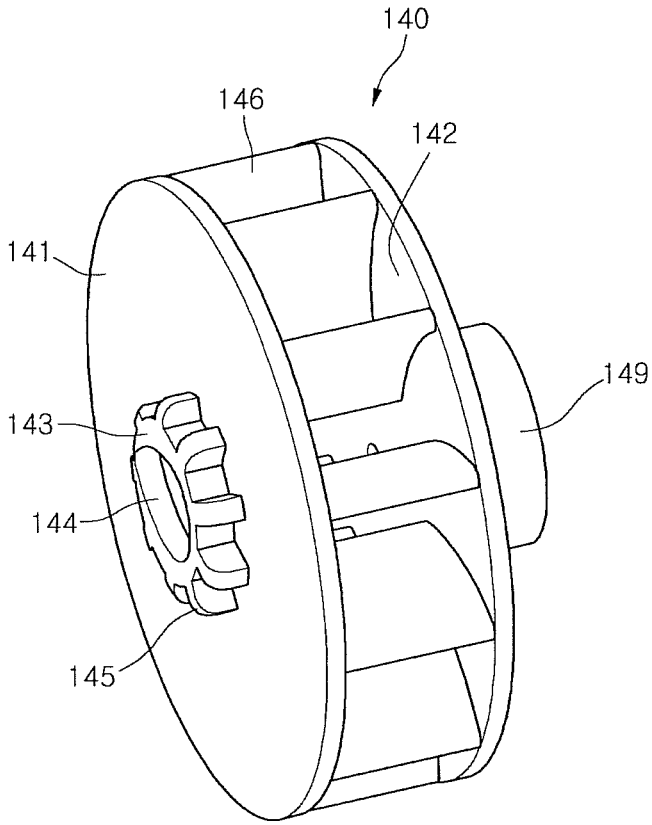
FIG. 4 is a perspective view of a second rotation member according to an embodiment.

As the rotation member 120 is coupled to the coupling hole 162, the connection member 160 is vertically reciprocated when the rotation member 120 is rotated. FIG. 3 is a perspective view of a first rotation member according to an embodiment. FIG. 4 is a perspective view of a second rotation member according to an embodiment.

Referring to FIGS. 3 and 4, the rotation member 120 according to an embodiment includes a first rotation member 130 constituting one side of the rotation member 120 and a second rotation member 140 constituting the other side of the rotation member 120. Here, the first and second rotation members 130 and 140 are coupled to each other to form the rotation member 120.

In detail, the first rotation member 130 includes first and second sidewalls 131 and 132 spaced from each other, a first blade 136 coupled between the first sidewall 131 and the second sidewall 132, and a coupling projection 134 disposed on a side of the first sidewall 131 and coupled to the second rotation member 140.

Each of the first and second sidewalls 131 and 132 has an approximately circular plate shape. Also, the first and second sidewalls 131 and 132 have sizes corresponding to each other. Also, both ends of the first blade 136 are coupled to the insides of the first and second sidewalls 131 and 132, respectively.

Due to the first and second sidewalls 131 and 132, the first rotation member 130 may be effectively rotated by the sucked air. That is, it may prevent the sucked air from being discharged in a side direction of the first rotation member 130 to smoothly rotate the first rotation member 130.

The first blade 136 has a rounded shape so that the first blade 136 is easily rotated by the sucked air. Also, the first blade 136 may be provided in plurality, and the plurality of first blades 136 are spaced from each other. About ten first blades 136 to about twelve first blades may be provided between the sidewalls 131 and 132. However, the number of blades 136 may be varied according to a distance spaced between the blades 136.

Also, the first sidewall 131 includes a first protrusion 133 protruding in a direction of the second rotation member 140 and a plurality of reinforcement ribs 135 extending to the outside of the first protrusion 133 to reinforce the strength of the first sidewall 131 and the first protrusion 133.

The coupling projection 134 further extends from a top surface of the first protrusion 133 toward the second rotation member 140. The first protrusion 133, the reinforcement rib 135, and the coupling projection 134 may be integrated with each other.

The coupling projection 134 is coupled to the second rotation member 140. The first rotation member 130 and the second rotation member 140 are integrally rotated by the coupling projection 134.

A rod insertion part 137 in which the first rotation rod 151 is inserted is defined in the coupling projection 134. The first rotation rod 151 inserted into the rod insertion part 137 extends toward the second sidewall 132.

As described above, the first blade 136 is stably fixed between the sidewalls 131 and 132. The coupling projection 134 is disposed on an outer surface the first sidewall 131 to transmit a rotation stress of the coupling projection 134 into the first sidewall 131.

That is, the stress generated by the rotation of the first and second rotation members 130 and 140 is absorbed into the first sidewall 131 and thus is not directly transmitted into the first blade 136. Thus, the twisting of the first blade 136 may be minimized.

Also, a first support member coupling part 139 coupled to the support member 170 is disposed outside of the second sidewall 132. The first support member coupling part 139 has a hollow shape with an empty space therein. The first support member coupling part 139 may be inserted into the outside of the rotation rod coupling hole 172.

The second rotation member 140 includes first and second sidewalls 141 and 142 spaced from each other, a second blade 146 coupled between the first sidewall 141 and the second sidewall 142, and a coupling projection receiving part 144 disposed on a side of the first sidewall 141 and coupled to the coupling projection 134.

The first and second sidewalls 141 and 142 and the second blade 146 have the same configuration and disposition as those of the first and second sidewalls 131 and 132 of the first rotation member 130 and the first blade 136. Thus, their detailed descriptions will be omitted.

The first sidewall 141 includes a second protrusion 143 protruding in a direction of the first rotation member 130 and a plurality of reinforcement ribs 145 extending to the outside of the second protrusion 143 to reinforce the strength of the first sidewall 141 and the second protrusion 143. Similarly, the second protrusion 143 and the reinforcement rib 145 have the same constitution as those of the first protrusion 133 and the reinforcement rib 135 of the first rotation member 130.

The coupling projection receiving part 144 is recessed inward from the second protrusion 143. Also, the recessed shape of the coupling projection receiving part 144 may correspond to a shape of the coupling projection 134.

Also, the coupling projection 134 has a height protruding from a top surface of the first protrusion 133 greater by a distance "a" (see FIG. 5) than a recessed depth of the coupling projection receiving part 144. Thus, in the first and second rotation members 130 and 140 are coupled to each other, the first and second rotation members 130 and 140 are spaced the distance "a" from each other. In detail, a distance spaced between the first and second protrusions 133 and 143 is the distance "a".

The coupling projection 134 and the coupling projection receiving part 144 have a gravity center and rotation center at positions different from each. This will be described later with reference to accompanying drawings.

Since the coupling projection 134 is inserted into the coupling projection receiving part 144, the first and second rotation members 130 and 140 may be integrally rotated by a momentum of the sucked air.

Also, a first support member coupling part 149 coupled to the support member 170 is disposed outside of the second sidewall 142. The first support member coupling part 139 has a hollow shape with an empty space therein. The first support member coupling part 139 may be inserted into the outside of the rotation rod coupling hole 172.

Figure 5:
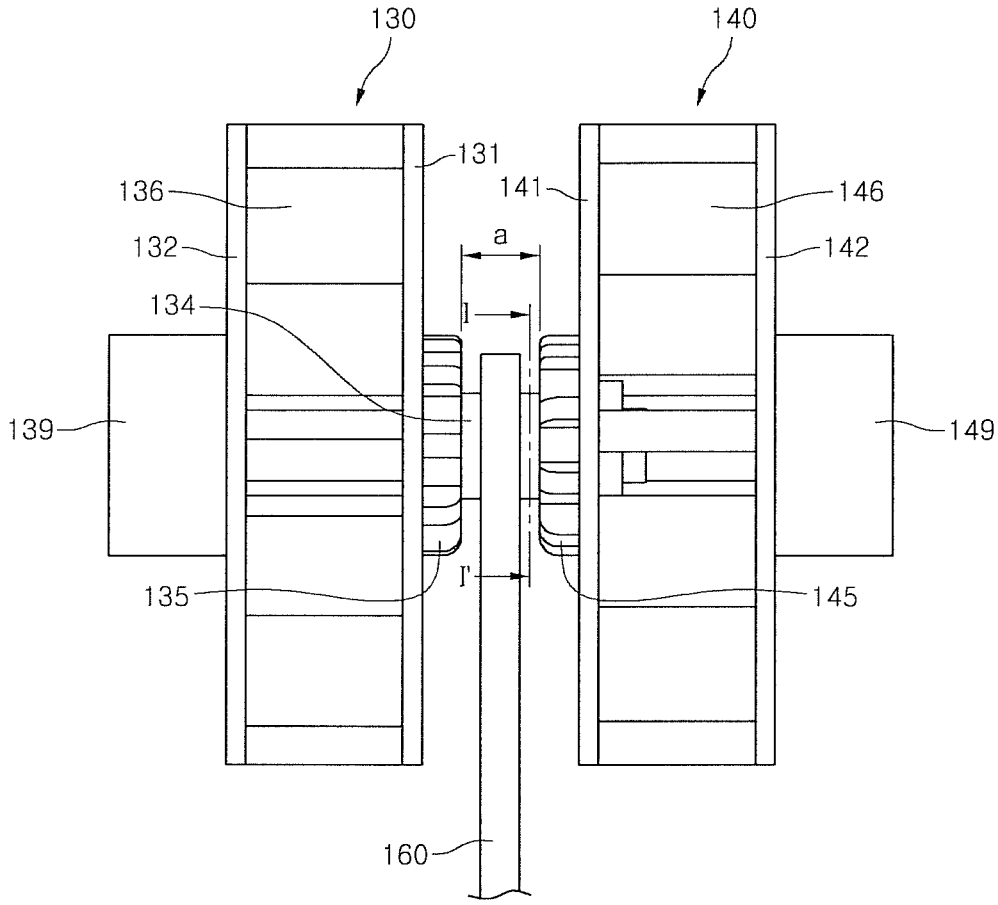
FIG. 5 is a view illustrating a coupled state of the rotation member according to an embodiment.
Figure 6:
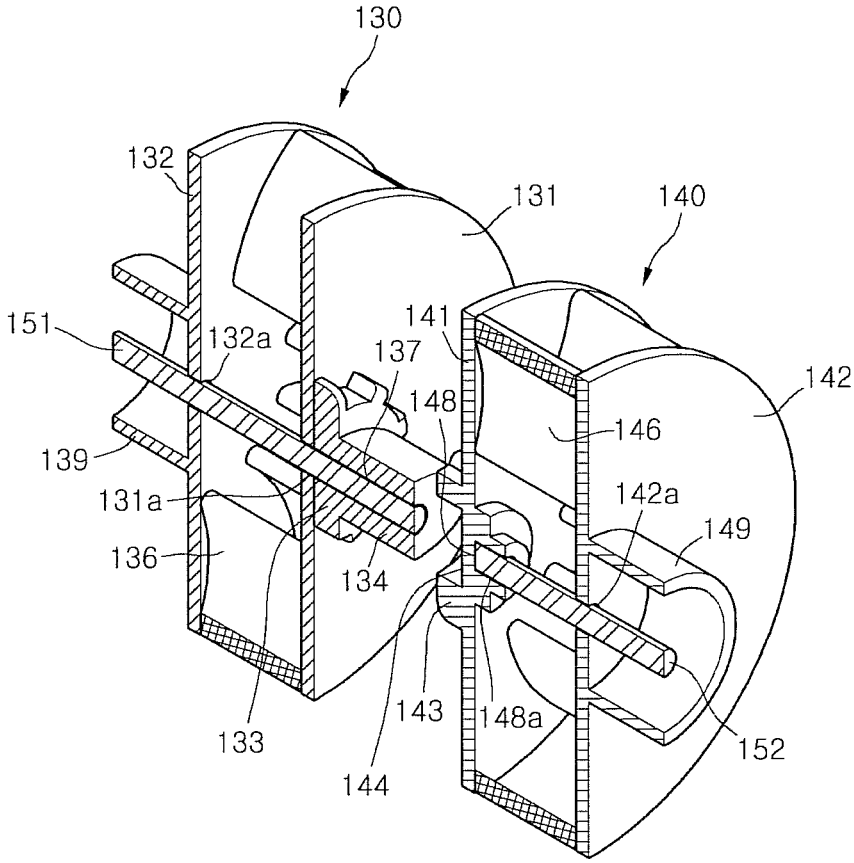
FIG. 6 is a sectional view illustrating a structure of the rotation member according to an embodiment.
Figure 7:
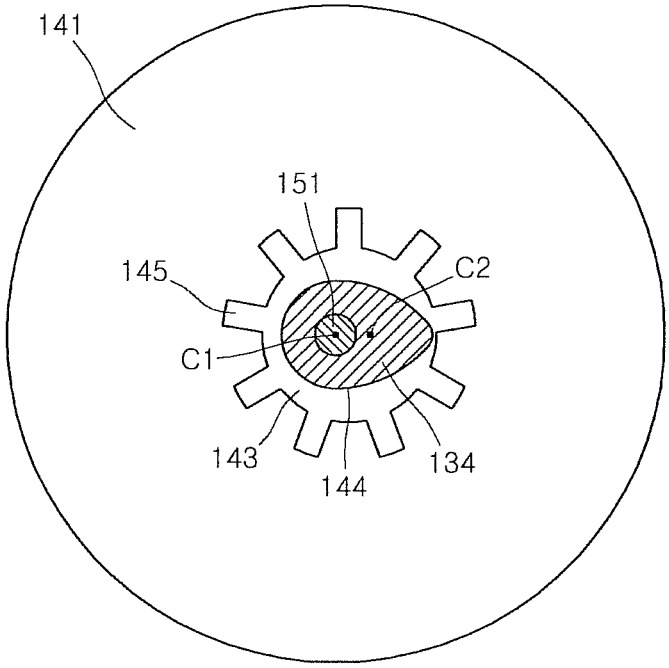
FIG. 7 is a sectional view taken along line I-I' of FIG. 5.

FIG. 5 is a view illustrating a coupled state of the rotation member according to an embodiment. FIG. 6 is a sectional view illustrating a structure of the rotation member according to an embodiment. FIG. 7 is a sectional view taken along line I-I' of FIG. 5.

Referring to FIGS. 5 to 7, the first and second rotation members 130 and 140 are coupled to form the rotation member 120 according to an embodiment. Also, a first rotation rod 151 and a second rotation rod 152 which serve as rotation centers are disposed inside the first and second rotation members 130 and 140, respectively.

In detail, a first sidewall through part 131*a* through which the first rotation rod 151 passes is defined in the first sidewall 131 of the first rotation member 130. A second sidewall through part 132*a* through which the second rotation rod 152 passes is defined in the second sidewall 132.

The first rotation rod 151 is inserted from the rod insertion part 137 and extends inward from the first support member coupling part 139 via the first and second sidewall through parts 131*a* and 132*a*. An end of one side of the first rotation rod 151 is disposed inside the rod insertion part 137, and an end of the other side of the first rotation rod 151 is coupled to the rotation rod coupling hole 172.

A shield part 148 for supporting the second rotation rod 152 is disposed inside the first sidewall 141 of the second rotation member 140, i.e., a back surface of the second protrusion 143. The shield part 148 includes a support part 148*a* extending in an inner direction of the first sidewall 141. The support part 148*a* surrounds an outer circumference of the second rotation rod 152 to easily support the second rotation rod 152.

Thus, the shield part 148 may constitute a portion of the first sidewall 141. Also, the shield part 148 may support an end of a side of the second rotation rod 152 so that the second rotation rod 152 does not protrude toward the first rotation member 130 by passing through the second sidewall 141.

Also, the second sidewall 142 has a second sidewall through part 142*a* through which the second rotation rod 152 passes. The second rotation rod 152 extends from one side surface of the shield part 148 toward the second sidewall 142. Also, the second rotation rod 152 may extend inward from the second support member coupling part 149 via the second sidewall through part 142*a*.

Thus, an end of e one side of the second rotation rod 152 is disposed inside the support part 148*a*, and an end of the other side of the second rotation rod 151 is coupled to the rotation rod coupling hole 172.

As described above, the first and second rotation rods 151 and 152 may be separated from each other by the shield part 148 to prevent the rotation rods 151 and 152 from being damaged. Also, the rotation rods 151 and 152 rotatably support the rotation members 130 and 140, respectively. Thus, stress transmitted into the rotation rods 151 and 152 may be reduced, and fatigue generated in the rotation rods 151 and 152 may be reduced.

The first and second rotation members 130 and 140 may be rotated at the same time using the first and second rotation rods 151 and 152 as rotation centers, respectively. The first and second rotation rods 151 and 152 may be horizontally disposed in a line.

Also, in a state where the first and second rotation members 130 and 140 are coupled to each other, the connection member 160 is coupled to the outside of the coupling projection 134. Here, the coupling projection 134 is inserted into the coupling hole 162 of the connection member 160. That is, the coupling hole 162 may have a size greater than that of the coupling projection 134.

Also, the connection member 160 is supported by the coupling projection 134 between the first and second protrusions 133 and 143. Thus, when the coupling projection 134 is rotated, the connection member 160 may be vertically moved.

As shown in FIG. 7, each of the coupling projection 134 and the coupling projection receiving part 144 may have an eccentric circular shape. That is, a gravity center C2 of the coupling projection 134 and the coupling projection receiving part 144 and a rotation center C1 of the coupling projection 132 and the coupling projection receiving part 144 are defined at positions different from each other.

Here, the coupling projection receiving part 144 is a groove defined in the second protrusion 143. Thus, the gravity center C2 and the rotation center C1 of the coupling projection receiving part 144 may be the gravity center and the rotation center of the second protrusion 143.

A distance from the rotation center C1 to an end of one side of the coupling projection 134 is different from that from the rotation center C1 to an end of the other side of the coupling projection 134.

In a state where the coupling projection 134 is coupled to the coupling projection receiving part 144, the coupling projection 134 may be integrally rotated with the first and second rotation members 130 and 140. Also, the connection member 160 may be vertically moved according to a height of a support surface for allowing the coupling projection 134 to support the connection member 160 when the coupling projection 134 is rotated.

If each of the coupling projection 134 and the coupling projection receiving part 144 has a circular shape, the height of the support surface of the coupling projection 134 is not varied even though the coupling projection 134 is rotated. Thus, the connection member 160 is not vertically moved.

Thus, since the coupling projection 134 and the coupling projection receiving part 144 have the eccentric circular shape, the connection member 160 may be vertically moved when the rotation member 120 is rotated.

Here, since the coupled portion of the coupling projection 134 and the coupling projection receiving part 144 serves as a rotation shaft of the rotation member 120, the gravity center C2 and the rotation center C1 of the rotation shaft of the rotation member 120 are defined at positions different from each other.

Unlike the drawings, the connection member 160 may be coupled to the first support member coupling part 139 or the second support member coupling part 149 or may be disposed on each of the first and second support member coupling parts 139 and 149. In this case, the first and second support member coupling parts 139 and 149 may have sectional areas so that the gravity center and the rotation center of the coupling projection 134 are defined at positions different from each other.

Also, the rotation member 120 may be formed as a single unit. The connection member 160 may be coupled to a side of the rotation member 120, i.e., the first and second support member coupling parts 139 and 149.

Hereinafter, a coupling process of the suction nozzle 10 will be described.

First, the coupling projection 134 of the first rotation member 130, the coupling projection receiving part 144 of the second rotation member 140, and the coupling hole 162 of the connection member 160 are aligned with each other. Then, the coupling projection 134 and the coupling projection receiving part 144 are coupled to each other within the coupling hole 162.

The first and second rotation rods 151 and 152 are coupled to the first and second rotation members 130 and 140, respectively. The support member 170 is coupled to both sides of the rotation member 120. The support member 170 is coupled to the rotation member 120 and also coupled to the first and second rotation rods 151 and 152.

In a state where the support member 170 and the connection member 160 are coupled to the rotation member 120, the rotation member 120 is seated on the seat part 110 of the nozzle body 100. The rotation member 120 is seated on the seat groove 112, and the support member 170 is inserted into the support member receiving part 114. The coupling end 164 of the connection member 160 passes through the through-hole (see reference numeral 116 of FIG. 8) to protrude downward from the nozzle body 100.

The swinging member 180 is couple to a lower side of the nozzle body 100, i.e., a side of the foreign material inflow hole 302 at the coupling end 164 protruding downward from the nozzle body 100. After the suction pipe 400 is seated on the nozzle body 100, when the upper cover 200 and the lower cover 300 are coupled to upper and lower portions of the nozzle body 100, the suction nozzle 10 is completely coupled.

Hereinafter, an operation of the suction nozzle 10 will be described.

Figure 8:
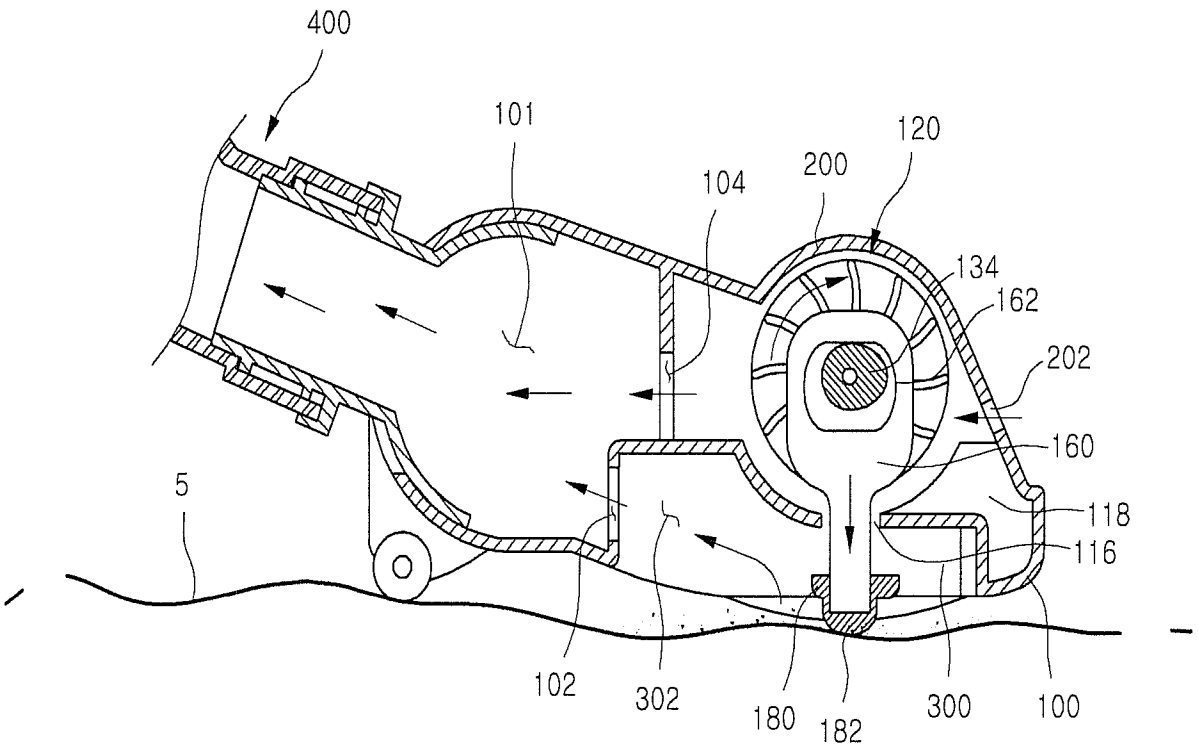
FIGS. 8 and 9 are sectional views illustrating an operation of the suction nozzle according to an embodiment.
Figure 9:
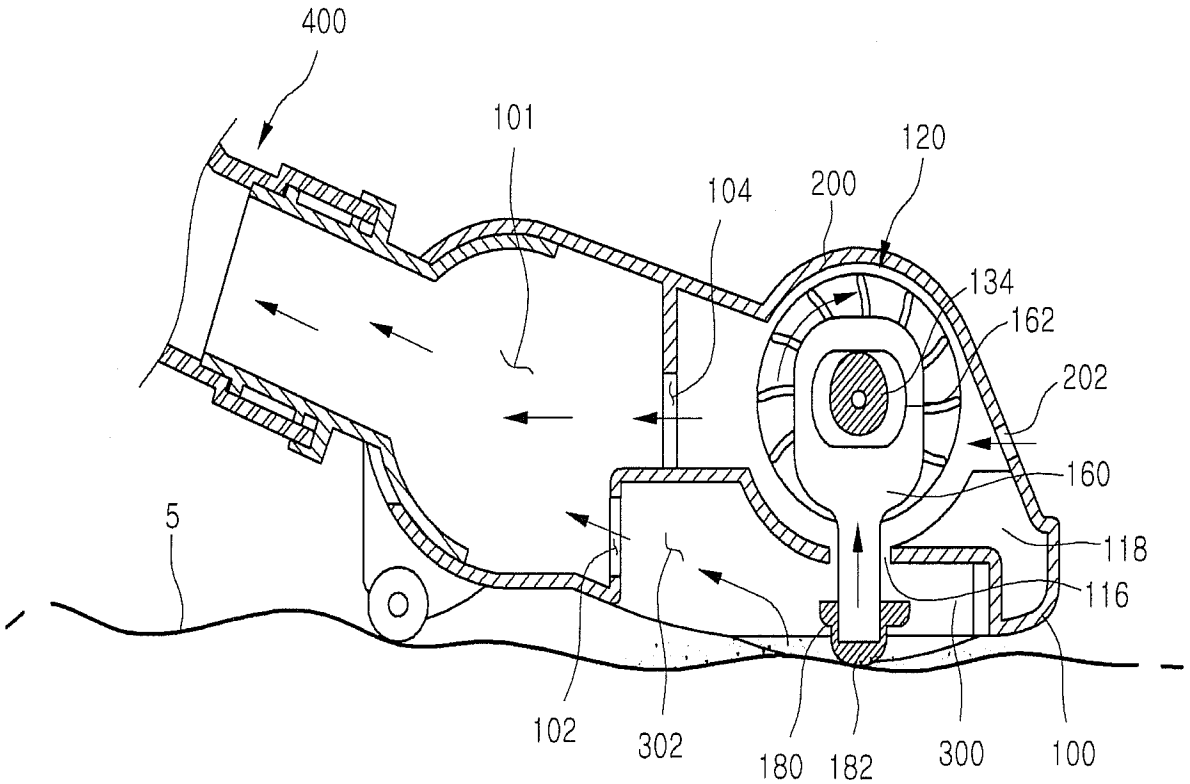

FIGS. 8 and 9 are sectional views illustrating an operation of the suction nozzle according to an embodiment. Here, FIG. 8 illustrates a state in which the swinging member 180 is moved downward, and FIG. 9 illustrates a state in which the swinging member 180 is moved upward.

Referring to FIGS. 8 and 9, when the user operates the vacuum cleaner, a suction force is generated by a suction force generation unit disposed inside the vacuum cleaner. Then, external air is sucked into the suction nozzle 10 through the air suction hole 202.

The air sucked through the air suction hole 202 is moved along the passage 119 defined by the guide rib 118. Thus, the rotation member 120 is rotated in a clockwise direction when viewed in FIG. 8 by the air flowing along the passage 119.

When the rotation member 120 is rotated, an upper end of the coupling projection 134 is varied in height. Thus, the connection member 160 supported by the upper end of the coupling projection 134 may be vertically moved. Also, the swinging member 180 is vertically swung by the connection member 160.

Here, FIG. 8 illustrates a state in which the coupling projection 134 is decreased in height to move the connection member 160 downward, and FIG. 9 illustrates a state in which the coupling projection 134 is increased in height to move the connection member 160 upward.

Since the swinging member 180 is vertically swung, the swinging member 180 hits the bedding 5 to generate vibration. The dusts on bedding 5 are separated from the bedding 5 due to the hitting of the swinging member 180.

Also, the air rotating the rotation member 120 is introduced into the space part 101 through the communication hole 104 and then is introduced into the cleaner main body through the suction pipe 400.

Also, the foreign materials and air separated from the bedding 5 are sucked into the foreign material suction hole 302 by the swinging of the swinging member 180. The air containing the foreign materials sucked through the foreign material suction hole 302 is introduced into the space part 101 through the inflow hole 102. Then, the air containing the foreign materials may be mixed with the air rotating the rotation member 120 and is introduced into the cleaner main body through the suction pipe 400.

As described above, since the suction nozzle 10 may blush off the dusts attached to the bedding 5 and also suck the dusts, the bedding 5 may be completely cleaned.

According to the embodiment, since the rotation force of the rotation member is changed into a vertical reciprocating movement by the connection member and transmitted into the swinging member, the dusts attached to the bedding are completely separated from the bedding by the swinging member to realize the complete cleaning of the bedding.

Also, since the dusts attached to the bedding are completely separated by the swinging member, the user may easily perform the cleaning without swinging the bedding one by one to brush off the dusts.

Also, since the guide rib for guiding the air flow is disposed inside the suction nozzle, the passage of the air sucked by the plurality of guide ribs may be reduced in sectional area to quickly and smoothly rotate the rotation member.

Also, since the rotation member is quickly and smoothly rotated, the vertical swinging rate of the swinging member may be increased to effectively brush off the dusts attached to the bedding.

Also, since the rotation member and the swinging member are smoothly rotated and swung, it may prevent the bedding from being absorbed onto the suction nozzle.

Also, the rotation rod may be disposed on each of the plurality of rotation members to distribute the rotation stress generated by the rotation of the rotation members into the plurality of rotation rods. Thus, it may prevent the rotation rods from being deformed or damaged.

Also, since the blade of the rotation member is supported by both sidewalls, the stress generated due to the twisting of the rotation member, which is applied to the blade, may be minimized even though the rotation force between the plurality of rotation members is changed by a difference of the amount of sucked air.

According to the embodiment, since the foreign materials attached to the bedding may be reduced by the swinging member disposed on the suction nozzle, industrial applicability may be significantly improved.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A nozzle of for a vacuum cleaner comprising:

a main body having a foreign material suction hole;

a plurality of rotation members rotatably disposed on the main body;

a connection member supported by the plurality of rotation members, the connection member adapted to be movable linearly; and a swinging member coupled to the connection member, the swinging member being vertically swung according to movement of the connection member, wherein the plurality of rotation members comprise a first rotation member and a second rotation member connected to the first rotation member, wherein each of the first and second rotation member comprises:

first and second sidewalls spaced from each other; and a blade fixed to each of the first and second sidewalls, wherein a coupling projection is disposed on one of the first and second sidewalls of the first rotation member; and a coupling projection receiving part to receive the coupling projection is disposed on one of the first and second sidewalls of the second rotation member.

2. The nozzle according to claim 1, wherein the coupling projection and the coupling projection receiving part have a gravity center and a rotation center at positions different from each other.

3. The nozzle according to claim 1, further comprising:

a first rotation rod passing through the coupling projection; and a second rotation rod extending from a back surface of the coupling projection receiving part.

4. The nozzle according to claim 1, further comprising:

a support member that allows the rotation member to be rotatably supported by the main body; and a rotation rod coupling hole defined in the support member, the rotation rod coupling hole coupled to the rotation rod of the rotation member.

5. The nozzle according to claim 1, wherein the connection member comprises:

a coupling hole coupled to an outside of a portion to which the plurality of rotation members are coupled;

a coupling end coupled to the swinging member.

6. The nozzle according to claim 1, wherein the rotation members comprises:

a rotation rod providing a rotation center; and a sidewall through part through which the rotation rod passes, the sidewall through part being defined in at least one of the first and second sidewalls.

7. The nozzle according to claim 6, wherein one of the first and second rotation members comprises a support part extending from one sidewall of the plurality of sidewalls toward the other sidewall to support an outer circumference of the rotation rod.

8. The nozzle according to claim 1, wherein the main body has an air suction hole through which air that rotates the rotation member is drawn.

9. The nozzle according to claim 1, wherein, in the coupling projection, a distance from a rotation center of the coupling projection to one end thereof is different from a distance from the rotation center to the other end thereof.

10. A nozzle of a vacuum cleaner comprising:

a main body having a foreign material suction hole;

a plurality of rotation members rotatably disposed on the main body;

a connection member supported by the plurality of rotation members, the connection member adapted to be movable linearly; and a swinging member coupled to the connection member, the swinging member being vertically swung according to movement of the connection member, wherein the plurality of rotation members comprise:

a plurality of sidewalls spaced from each other; and a blade fixed to each of the plurality of sidewalls, wherein the plurality of rotation members comprise:

a first rotation member on which a coupling projection is disposed on one sidewall of the plurality of sidewalls; and a second rotation member having a coupling projection receiving part to receive the coupling projection, wherein a first rotation rod passes through the coupling projection; and a second rotation rod extends from a back surface of the coupling projection receiving part.

* * * * *